United States Patent [19]

Pfeil et al.

[11] 3,994,133

[45] Nov. 30, 1976

[54] AUTOMATIC CONTROL DEVICE FOR THE DISTRIBUTION OF HYDRAULIC FLUID BETWEEN TWO HYDRAULIC CIRCUITS

[75] Inventors: Christian Pfeil, Neuss (Rhine); Hans Breidenbach, Delrath, both of Germany

[73] Assignee: International Harvester Company, Chicago, Ill.

[22] Filed: July 24, 1975

[21] Appl. No.: 598,607

[30] Foreign Application Priority Data

July 24, 1974 Germany ..... 2435602

[52] U.S. Cl. ..... 60/422; 60/468; 91/412

[51] Int. Cl.[2] ..... F15B 11/20; F15B 13/09

[58] Field of Search ..... 60/422, 430, 468; 91/412; 137/101

[56] References Cited

UNITED STATES PATENTS

| | | | |
|---|---|---|---|
| 3,279,558 | 10/1966 | Allen et al. | 60/422 X |
| 3,355,994 | 12/1967 | Malott | 60/422 |
| 3,535,877 | 10/1970 | Becker | 60/422 |

*Primary Examiner*—Edgar W. Geoghegan
*Attorney, Agent, or Firm*—Raymond E. Parks; Floyd B. Harman

[57] ABSTRACT

In a hydraulic power system having two independent circuits, wherein one circuit has priority over the other circuit, and the priority circuit furnishes a residual flow to the non-priority circuit, a pressure sensing system is provided in the return flow line of the non-priority circuit which causes a directional flow valve to shift and direct the residual flow back to the priority circuit in the event of a leak in the non-priority circuit which results in a loss of pressure in the return line.

10 Claims, 2 Drawing Figures

AUTOMATIC CONTROL DEVICE FOR THE DISTRIBUTION OF HYDRAULIC FLUID BETWEEN TWO HYDRAULIC CIRCUITS

BACKGROUND OF THE INVENTION

In general this invention relates to a hydraulic control system having two hydraulic circuits wherein the first circuit provides a residual flow to the second circuit and said first circuit has priority over said second circuit. More particularly, the invention relates to a control valve means for directing the residual flow back into the first circuit in the event of a drop or loss of operating pressure in the second or non-priority circuit.

FIELD OF THE INVENTION

This invention is applicable to agricultural and industrial type of tractor vehicles wherein there is one hydraulic circuit provided for use in steering the vehicle and a second hydraulic circuit is provided for use in operating a hydraulic implement or accessory. In many working operations, the steering circuit of the tractor is not used or is operated at less than maximum capacity. The pump supplying fluid to the steering circuit is generally of the constant delivery type; and the circuit includes an open center type of flow control valve, so that the output of the pump is circulated back to the reservoir in the absence of any steering operation. There is also a constant delivery pump supplying fluid to the accessory circuit and there is also an open center type of flow control valve in this circuit which recirculates the output of the pump back to the reservoir in the absence of any operation of the associated hydraulic equipment.

Since the fluid demands of the hydraulically operated accessory equipment may be greater at times than the pump can supply, valve means are provided for tapping a portion of the excess fluid in the steering circuit into the accessory circuit. There are various laws and regulations in many countries regarding hydraulic steering systems in tractor vehicles which require that some means must be provided to insure that the steering circuit receives all of the available fluid upon demand of the steering circuit and in the event of a leak or break in the accessory circuit. The present invention provides such a means as will be described later on in the description.

DESCRIPTION OF THE PRIOR ART

An automatic control device of the aforementioned type is known through the German Pat. No. 1,150,342 (Corresponds to U.S. Pat. No. 3,334,705—Lam—Aug. 8, 1967). The spool of this known volume control valve is controlled by differential pressures in the control chambers. With this known device it is not possible to guarantee the supply of the primary circuit with the pressure medium in cases where a line failure occurs in the secondary circuit while the steering system is inoperational. In such a case the presence drop developing in the one control chamber moves the spool to a position where the connection between the hydraulic fluid reservoir and the secondary hydraulic circuit is maintained. Consequently there is danger of an insufficient quantity of hydraulic fluid being available to the primary hydraulic circuit in case of emergency, since the available hydraulic fluid can escape through the leak in the line.

In the U.S. Pat. No. 3,024,798 — Banker — Mar. 13, 1962, there is shown a valve which automatically diverts the excess flow of the primary circuit to a secondary circuit. There are no means shown which will terminate the excess flow in the event of a leak in the secondary circuit. The flow into the secondary circuit will maintain the valve in an open position.

In the U.S. Pat. No. 3,323,533 — Reimer — June 6, 1967, there is shown a valve which balances the flow between two branch circuits, one which having priority over the other. There are no means shown which will terminate flow to the non-priority branch should a leak occur in said branch which would result in a loss of pressure.

And, in the U.S. Pat. No. 3,618,628 — Kramer — Nov. 9, 1971 the priority valve interrupts flow to the excess fluid line upon a rise in pressure in the excess fluid line above a predetermined valve. Whereas in the present invention, flow to the excess fluid line is interrupted upon a decrease in pressure in the excess fluid line.

SUMMARY OF THE INVENTION

This invention is based upon the objective of providing an automatic control device of the aforementioned design, where in every case of line failure in the secondary hydraulic circuit there is a sufficient supply of hydraulic fluid delivered to the primary hydraulic circuit. According to the invention this objective is achieved by using a by-pass valve which is operated by the back-pressure in the secondary hydraulic circuit. The by-pass valve shuts off the delivery of residual fluid to the secondary circuit in the event of a leak in the secondary circuit which drops the pressure in said circuit. By the means provided in accordance with this invention it is assured that the back pressure of the secondary circuit will always act upon the by-pass valve in such a manner that with the loss of pressure in the return line of the secondary circuit the by-pass valve will cut off the secondary circuit from the residual flow of the primary circuit. It is further assured by other means that the hydraulic fluid flowing from the hydraulic fluid reservoir into the prime circuit pump is delivered with priority into the primary hydraulic circuit upon demand, thus providing the priority or primary circuit with sufficient hydraulic fluid at all times.

Accordingly, there is provided in a hydraulic power system having two independent circuits wherein one circuit has priority over the other circuit, and the priority circuit furnishes a residual flow to the non-priority circuit, a control means for directing the residual flow back to the priority circuit in the event of a leak and loss of pressure in the non-priority circuit. The control means comprise a first directional flow control valve which has an input port and two spaced apart output ports. One of the output ports communicates with the priority circuit and the second output port communicates with the residual flow line. The valve has an axially shiftable valve spool means and there are first and second fluid pressure chambers at the ends of the spool means. The second chamber has a compression spring therein. The fluid and the spring in the chambers operate to shift the spool in opposite axial directions for opening and closing fluid communication from the input port to the second output port. There is also an input flow line connected to the priority circuit and a first branch line connected thereto and to the first chamber for pressurizing the chamber and shifting the spool valve means against the forces of the spring and fluid pressure in the second chamber. A pressure regulating valve means is provided in the input flow line for creating a pressure differential in the input flow line downstream of the regulating valve. There is a second branch line, on the downstream side of the pressure regulating valve, in the input flow line which is connected to the second chamber for pressurizing the second chamber at a pressure less than that of the first chamber. A second directional flow control valve is also provided which has an inlet port and two spaced apart outlet ports. There is also an axially shiftable valve spool means in this valve and one fluid pressure chamber at one end of the spool means and a compression spring at the other end of the spool means for shifting the spool means and alternating fluid communication from the inlet port between the two outlet ports. There is also a fluid return line connected to the non-priority circuit which has a pressurizing valve means for creating a back pressure in the line upstream of the valve means. A back pressure branch line means is connected to the pressurized side of the return line and to the fluid pressure chamber of the second directional flow control valve for pressurizing this chamber and shifting the spool means therein against the force of the spring.

In one embodiment of the invention a two position valve is used for a by-pass valve. The valve has hydraulic and mechanically actuated servo means for changing the positions of the valve. In an appropriate design a servo valve spool of a by-pass valve can be loaded by a back-pressure control line arranged upstream of a pressurizing valve and connected to the return line of the secondary hydraulic circuit.

In this case the by-pass valve can either be arranged in a control line of the volume or flow control valve connecting a pressure line of the hydraulic fluid reservoir to one of the control chambers of the valve spool, or it can be designed as a monitoring valve connected at the outlet of the volume or flow control valve. While in the first case an indirect by-passing of the secondary hydraulic circuit is achieved, in the second case the desired effect is achieved by a direct by-passing of the pressure medium flowing additionally from the primary hydraulic circuit to the secondary hydraulic circuit. The arranging of the by-pass valve in the control line of the volume or flow control valve presents the advantage of requiring only light control flows and pressures which results in a delicately sensitive reversing in cases of emergency.

BRIEF DESCRIPTION OF THE DRAWING

In order that the invention may be readily understood and put into practical effect, reference will now be made to the two figures of the drawing in which.

DESCRIPTION OF THE PREFERRED EMBODIMENT

Figure 1:
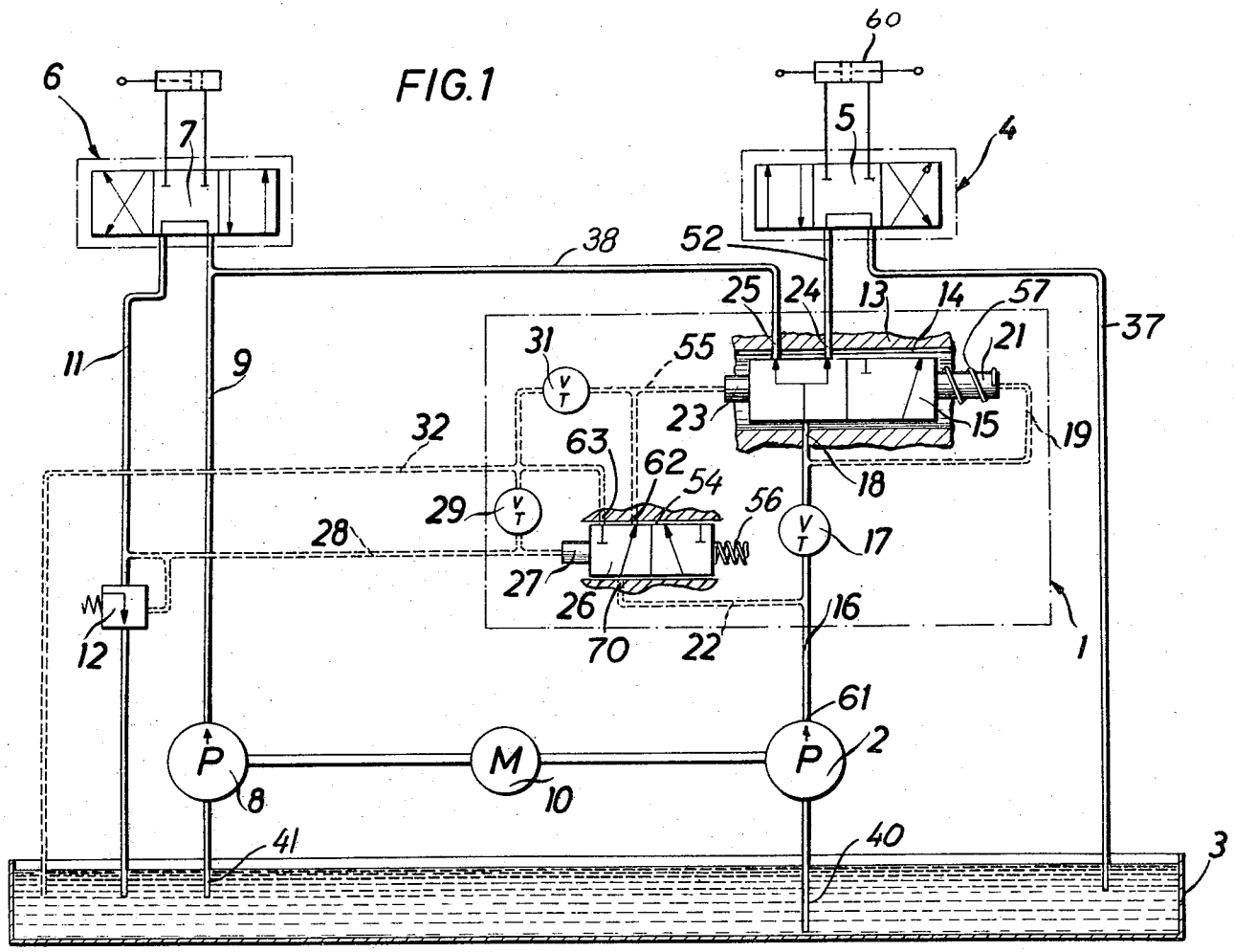
FIG. 1 is a schematic representation of a hydraulic power system having a priority steering circuit and a non-priority accessory circuit with the invention incorporated therein.
Figure 2:
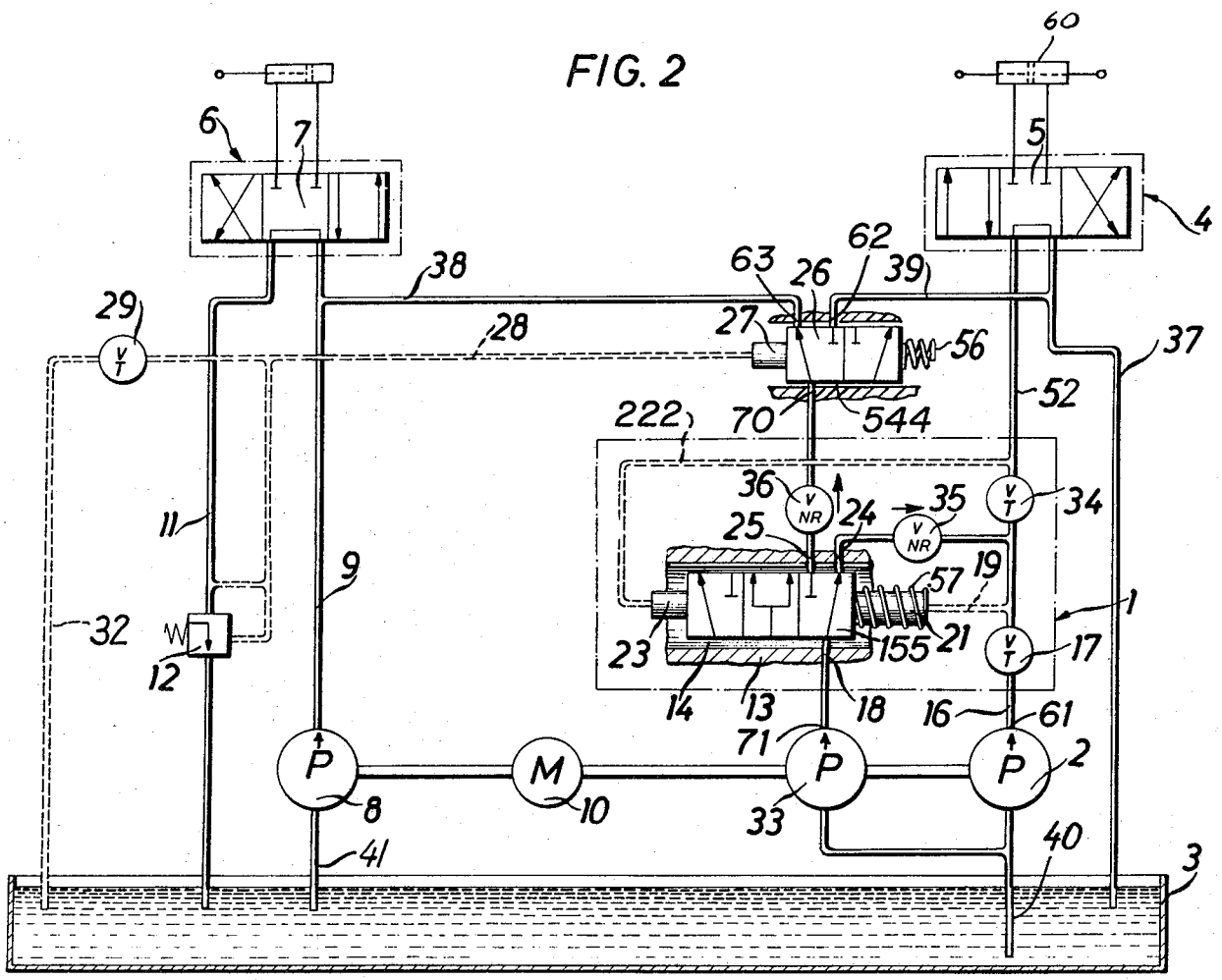
FIG. 2 is a schematic representation of a second embodiment of the hydraulic power system shown in FIG. 1 with the invention incorporated therein.

With reference to FIGS. 1 and 2, there is shown schematically a hydraulic power system for use in agricultural and industrial type tractors wherein there is one hydraulic circuit 4 provided for use in steering the vehicle and a second hydraulic circuit 6 provided for use in operating a hydraulic accessory such as a backhoe.

Now with reference to FIG. 1, the hydraulic power system has a common hydraulic fluid reservoir 3 for the two circuits 4 and 6. The steering or priority circuit comprises a pump 2 of the constant delivery type which has an intake line 40 disposed lower in the reservoir 3 than the intake line 41 of the second pump 8 which services the accessory or non-priority circuit 6. A conduit or first fluid delivery line 16 is connected at one end to the output port 61 of the priority circuit pump 2 and at the other end to an input port 18 in a flow control valve 1. A first pressure regulating valve or restrictor 17 is provided in the delivery line 16 upstream of the input port 18. The flow control valve 1 has two spaced apart output ports 24 and 25 which are controlled by an axially shiftable spool valve element 15. The right hand or second output port 25 services the priority circuit and the left hand port connects to a residual flow line 38 which communicates with the accessory or non-priority circuit. Hydraulic fluid passes through the first output port 24 into an inlet line 52 which is connected to an inlet port of a hydraulic steering control valve 5. The steering valve is of the open center type and has three axially shiftable positions. A double acting hydraulic cylinder or motor 60 is connected to two reversible flow ports in the valve which direct fluid to and from the cylinder on opposite sides of a piston that is connected to the means for steering the vehicle. The secondary or non-priority hydraulic accessory circuit is designated 6 and also has a multiple position valve 7 of the open center type. The hydraulic fluid is delivered to the inlet port of the valve 7 from the reservoir 3 through the second fluid delivery or pressure line 9 which is connected to the second constant delivery pump 8. In the central position of the valve 7 the fluid is returned through the open center valve element to the hydraulic fluid reservoir 3 by way of a return or discharge line 11. Both pumps, 2 and 8, are driven by a common drive motor 10. A pressurizing valve means 12 is installed in the fluid flow return or discharge line 11 of the secondary hydraulic circuit 6 to provide a pressure in the discharge line as will be explained later on.

The volume or flow control valve 1 has a housing 13 with a longitudinal bore 14 therein in which a valve element such as a two position spool 15 is movably supported. In the pressure or input line 16 which is connected to the output port 61 of the steering pump 2, the first pressure regulating valve or restrictor 17 is installed. Downstream of the first pressure regulating valve or restrictor 17 there is provided one branch line 19, hereinafter termed the second control line, which leads to one pressure control chamber 21, hereinafter termed the second control chamber. The second control chamber 21 also contains a compression spring 57. Further on downstream the first restrictor 17 connects into the input port 18 of the bore 14. Another branch line 22, hereinafter termed the first control line, branches off from the input flow line 16 between the output port 61 of the pump 2 and the first pressure regulating valve 17 and leads to the other pressure control chamber 23, hereinafter termed the first control chamber, at the opposite side of the spool 15. By the differential pressures developed in the first and second control chambers 23 and 21 and the force of the spring 57, the spool 15 is normally held in an initial first position such as shown in FIG. 1. The flow entering input port 18 passes through the first outlet port 24 and into the line 52 which is connected to the inlet port of the steering control valve 5. The second output port 25 is connected to the line 38 which is connected to the input line 9 of the second circuit 6. In the balanced position of the spool valve 15 a residual flow from the first circuit 4 can pass into the input line 9 of the secondary hydraulic circuit 6.

An inlet port 70 in a two position by-pass valve 26 is connected to the first branch or control line 22 downstream of the connection of the first branch line 22 to the input flow line 16. The by-pass valve 26 has a spool 54 supported in a manner allowing axial movement to the two positions. One end of the spool 54, is spring loaded by spring 56 and the opposite end has a pressure control chamber 27. A back pressure branch or control line 28 connects this third pressure control chamber 27 to the fluid flow return line 11 of the secondary hydraulic circuit 6 upstream of the pressurizing valve means 12 in the return conduit 11 which charges the return line 11 and the control line 28 with pressure. The back pressure control line 28 drains through a second pressure regulating valve or restrictor 29 into a drain or discharge line 32 which is connected to the reservoir 3. One outlet port 62 in the by-pass valve 26 communicates with an input pressure line 55 which is connected to the first pressure control chamber 23. Input pressure line 55 also drains through a third restrictor 31 into the drain line 32. By means of the second and third restrictors or pressure regulating valves 29 and 31 there is a constant minute draining of fluid in the back pressure and input pressure control lines 28 and 55 so that there is a constant flow of hydraulic fluid through these lines into the back pressure and input pressure control chambers 27 and 23 for maintaining the control spools 54 and 15 pressed against their respective springs 56 and 57 and in the position shown in FIG. 1.

Normally the by-pass valve 26 is held in the position shown in FIG. 1 by the pressure in the back pressure control line 28, so that the input flow coming through the control pressure a first branch line 22 passes through the one outlet port 62 in valve 26 and flows into the input pressure control line 55 and pressurizes the input pressure or first chamber 23. As explained previously, the spool 15 is then urged into the position shown in FIG. 1 against the force of the spring 57 and the differential pressure in the second chamber 21 where a constant flow from the pump 2 is directed through the spool 15 to the line 52 of the primary hydraulic circuit 4 through first output port 24 and a residual flow is directed to the line 38 of the secondary hydraulic circuit 6 through second output port 25. If for some reason, perhaps due to a line failure in the secondary hydraulic circuit 6 which causes the hydraulic pressure to drop, then, due to the connection between the back pressure or third chamber 27 of valve 26 and the fluid flow return line 11 by way of the back-pressure control line 28, the pressure in the third chamber 27 also drops, so that the by-pass valve spool 54 is moved by the force of the spring 56 to the second position. In the second position the input pressure control or first branch line 22 is connected to a second outlet port 63 in the by-pass valve 26 which is connected to the discharge line 32. Since flow is now interrupted to the input pressure control line 55 and to the first control chamber 23 the pressure drops in control chamber 23 due to the draining of line 55 and chamber 23 through the third restrictor 31 into the drain line 32. The fluid pressure in the second control chamber 21 together with the force of the spring 57 shifts th control spool 15 to the second position, thus connecting the input port or inlet 18 solely with the one or first output port 24 which is connected to line 52 of the primary hydraulic circuit 4. The flow to the second output port 25 which is connected to the residual flow line 38 is terminated and the entire volume of hydraulic fluid from the steering pump 2 is then exclusively fed into line 52 of the primary hydraulic circuit 4 through the first output port 24. Thus in the event of a line failure in the secondary hydraulic circuit 6, the steering capacity of the vehicle still can be fully maintained.

The second hydraulic system, which is shown in FIG. 2, basically follows the same operating principle as the FIG. 1 system. Corresponding components are marked by identical references. An initial difference can be seen in the output part 61 of the steering pump 2 not being connected to the input port 18 of the volume or flow control valve 1. Another difference is that the control valve 1 has a three position spool 155 and the inlet 18 is supplied with hydraulic fluid via an output port 71 of an additional switch pump 33. Pump 2 is connected directly to the three position steering valve 4 through first and second pressure regulating valves or restrictors 17 and 34, which are in series in the input pressure line 16. Check or one-way valves 35 and 36 are respectively connected to the two output ports 24 and 25 in the volume or flow control valve 1. In the input line 16 downstream of the second pressure regulating valve or restrictor 34, an input pressure control or first branch line 222 branches off into the first control chamber 23. Between the two restrictors 17 and 34 a second control line 19 branches into the second control chamber 21 which also contains the spring 57 for spring loading the valve spool 15. The inlet port 70 of the by-pass valve 26 is now connected to the second output port 25. In one axial position of the spool 544 in the by-pass valve 26, the second output port 25 in valve 1 is connected to the residual flow line 38 via the second outlet port 63 and in the second axial position it is connected via the second outlet port 63 to a drain line 39 which is connected to the return flow line 37 of the primary hydraulic circuit 4. The volume or flow control valve 1 is designed in form of a demand valve and thus at low speeds of the drive motor 10 feeds the hydraulic fluid coming from the steering pump 2 and from the switch pump 33 exclusively into the primary hydraulic circuit 4. However, at mean speeds of the drive motor 10 the respective axial displacement of the spool 155 causes the hydraulic fluid delivered by the switch pump 33 to be directed, via the first and second outlet ports 24, 25, partly to the primary and partly to the secondary hydraulic circuit. With the drive motor 10 operating at high speeds, the volume of hydraulic fluid delivered by the switch pump 33 is fed exclusively via the second output port 25 into the secondary hydraulic circuit 6.

Due to the pressure loading of the third chamber 27 in valve 26, by the back-pressure control line 28, the by-pass valve 26, which is designed in form of a safety valve, normally takes the position shown in FIG. 2, so that the additional volume of hydraulic fluid from the primary hydraulic circuit 4, when valve spool 155 is in its second or third operative position, can be directed to the secondary hydraulic circuit 6. In case of a line failure occurring in the secondary hydraulic circuit 6, the pressure in the back-pressure control line 28 drops immediately, thus causing the spring 56 to shift the spool 54 in the by-pass valve 26 to its second position, where the volume of hydraulic fluid coming from the switch pump 33, when valve spool 155 is in its second or third operative position, flows via the first outlet port 62 into the connecting line 39 and into the drain line 37 of the primary hydraulic circuit 4.

To facilitate on demand a constant delivery by the steering pump 2 and the switch pump 33, their common suction or intake line 40 is arranged lower than intake line 41 of the feed pump 8 in the hydraulic fluid reservoir 3.

The embodiments of the invention in which an exclusive property or privilege is claimed are defined as follows:

1. In a hydraulic power system having two independent circuits wherein one circuit has priority over the other circuit, and the priority circuit furnishes a residual flow to the non-priority circuit, a control means for directing the residual flow back to the priority circuit in the event of a leak and loss of pressure in the non-priority circuit, comprising:

a first directional flow control valve having an input port and two spaced apart output ports, one output port communicating with the priority circuit and the second output port communicating with a residual flow line, an axially shiftable valve spool means in the valve including a first and second fluid pressure chambers at the ends of the spool means and a compression spring in the second chamber for shifting the valve means in opposite axial directions and opening and closing fluid communication from the input port to the second port;

an input flow line connected to the priority circuit;

a first branch line means connected to the input flow line and to the first chamber for pressurizing said chamber and shifting the spool valve means against the forces of the spring and fluid pressure in the second chamber;

a pressure regulating valve means in the input flow line for creating a pressure differential in said line downstream of said regulating valve means;

a second branch line means connected to the input flow line on the downstream side of said pressure regulating valve means and to the second chamber for pressuring said chamber at a pressure less than that of the first chamber;

a second directional flow control valve having an inlet port and two spaced apart outlet ports, an axially shiftable valve spool means in the valve including a fluid pressure chamber at one end of the spool means and a compression spring at the other end for shifting the spool means and alternating fluid communication from the inlet ports between the two outlet ports;

a fluid flow return line connected to the non-priority circuit; a pressurizing valve means in the return line for creating a back pressure in said return line upstream of said pressurizing valve means; and a back pressure branch line means connected to the return line on the pressurized side thereof and to the fluid pressure chamber of the second directional flow control valve for pressurizing said chamber and shifting the spool means therein against the force of the spring.

2. The invention as claimed in claim 1, wherein the inlet port of the second directional flow control valve is connected to the first branch line means and one of the outlet ports is connected to the first chamber of the first flow control valve and the other outlet port is connected to a drain line communicating with a fluid reservoir.

3. The invention as claimed in claim 2, wherein the first chamber of the first flow control valve is connected to the drain line by means of a first flow restrictor valve and the fluid pressure chamber of the second directional flow control valve is connected to the drain line by means of a second flow restrictor valve.

4. The invention as claimed in claim 1, wherein the priority and non-priority circuits each include a constant delivery type of pump having an intake line depending into a common fluid reservoir and wherein the intake line for the priority circuit pump depends deeper into the reservoir than the intake line for the non-priority circuit pump; and wherein the priority circuit pump has a discharge port connected to the input flow line upstream of the pressure regulating valve means.

5. The invention as claimed in claim 4, wherein the input port of the first directional flow control valve is connected to the downstream side of the pressure regulating valve means.

6. The invention as claimed in claim 4, wherein the first branch line is connected to the input flow line upstream of the pressure regulating valve means.

7. The invention as claimed in claim 1, wherein the inlet port of the second directional flow control valve is connected to the second output port of the first directional flow control valve and one of the second flow control valve outlet ports is connected to the residual flow line and the other outlet port is connected to a drain line communicating with a fluid reservior.

8. The invention as claimed in claim 7, wherein the fluid pressure chamber of the second directional flow control valve is connected to the drain line by means of a flow restrictor valve.

9. The invention as claimed in claim 1 wherein the priority circuit has a constant delivery type of pump and a switch type of pump and the non-priority circuit has a constant delivery type of pump, the two priority circuit pumps having a common intake line and the non-priority circuit pump having an intake line depending into a common fluid reservoir and wherein the common intake line depends deeper into the reservoir than the intake line for the non-priority circuit pump; and wherein the switch type pump has a discharge port connected to the input port of the first directional flow control valve and the other priority circuit pump has a discharge port connected to the input flow line upstream of the pressure regulating valve means.

10. The invention as claimed in claim 9, wherein there is a second pressure regulating valve means in the input flow line downstream of the first mentioned pressure regulating valve, means and wherein the first chamber of the first directional flow control valve is connected to the input flow line downstream of the second pressure regulating valve means.

* * * * *